United States Patent [19]

Brugman

[11] Patent Number: 4,665,674

[45] Date of Patent: May 19, 1987

[54] GRID CEILING

[75] Inventor: Johannes A. Brugman, Rotterdam, Netherlands

[73] Assignee: Hunter Douglas International N.V., Curacao, Netherlands

[21] Appl. No.: 805,643

[22] Filed: Dec. 6, 1985

[30] Foreign Application Priority Data

Apr. 11, 1985 [GB] United Kingdom ..... 8509345
Sep. 11, 1985 [GB] United Kingdom ..... 8522473

[51] Int. Cl.[4] ..... E04B 5/52
[52] U.S. Cl. ..... 52/488; 52/665
[58] Field of Search ..... 52/660–669, 52/484, 488, 489, 714

[56] References Cited

U.S. PATENT DOCUMENTS

| | | | |
|---|---|---|---|
| 3,187,856 | 6/1965 | Lydard | 52/667 |
| 3,287,874 | 11/1966 | Stahlhut | 52/484 |
| 3,369,332 | 2/1968 | Harlan | 52/667 |
| 3,370,301 | 2/1968 | Harlan | 52/664 |
| 4,034,534 | 7/1977 | Taylor | 52/668 |
| 4,479,341 | 10/1984 | Schuplin | 52/714 |

FOREIGN PATENT DOCUMENTS

| | | | |
|---|---|---|---|
| 0049432 | 4/1982 | European Pat. Off. | 52/484 |
| 0115415 | 8/1984 | European Pat. Off. . | |
| 1403026 | 8/1975 | United Kingdom . | |
| 2122666 | 1/1984 | United Kingdom . | |

*Primary Examiner*—James L. Ridgill, Jr.
*Attorney, Agent, or Firm*—Pennie & Edmonds

[57] ABSTRACT

A grid ceiling comprising a set of first parallel channel section elongate members and a set of second parallel channel section elongate members, the first members being so arranged transverse to the second members as to form a grid with polygonal spaces therein. Each channel shaped member includes a lower portion and two spaced side flanges extending upwardly therefrom. At least one integral hook is formed at each of the ends of the second members and co-operating first openings are formed in at least one side flange of the first members at first position situated at regular, spaced intervals therealong, so that the hooks of the second members can be engaged in said first openings to form said grid ceiling. A series of one or more second openings are formed in at least one side flange of the second member at second position situated at regular, spaced intervals therealong. The second openings are so shaped that, when the second members are cut at the relevant second positions transverse to the length of the second members, at least one of said integral hooks is formed.

9 Claims, 6 Drawing Figures

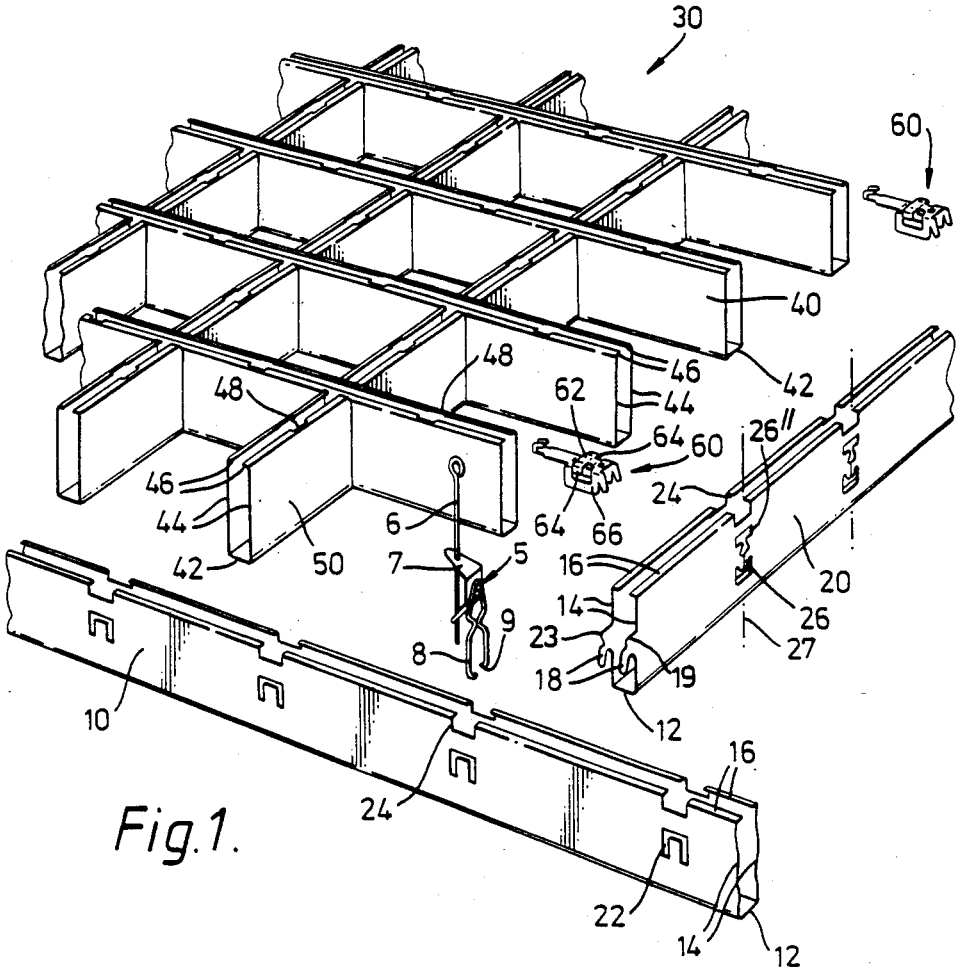
Fig. 1.
Fig. 2.
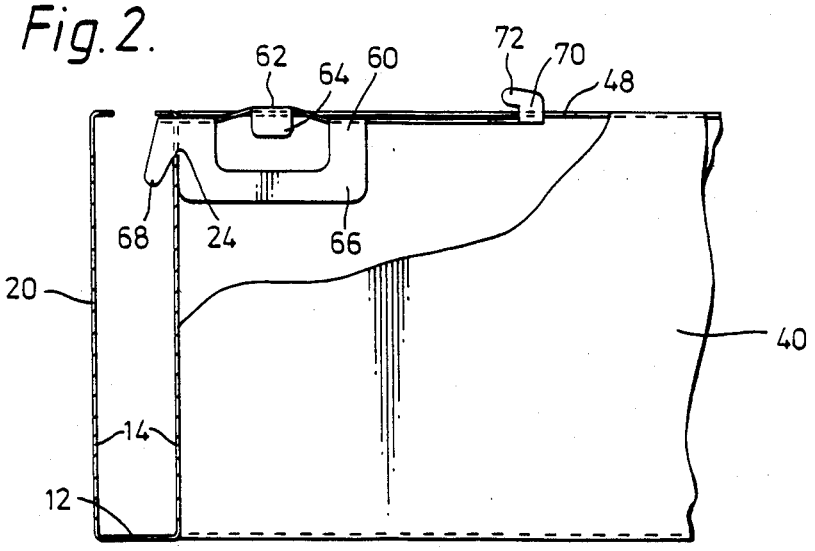

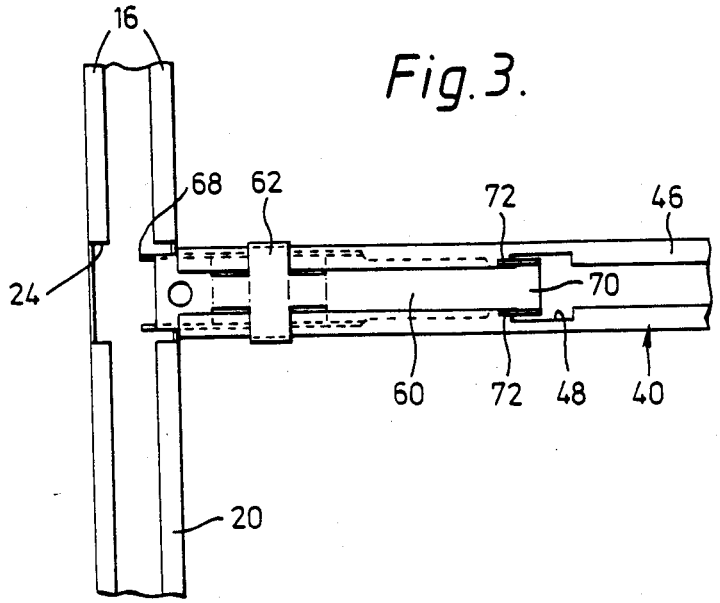
Fig. 3.
Fig.4A.
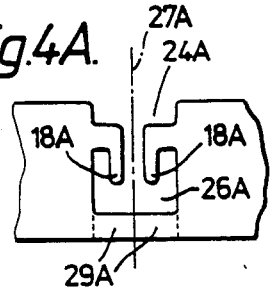
Fig.4B.
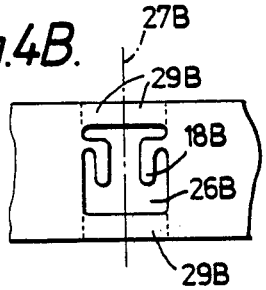
Fig.4C.
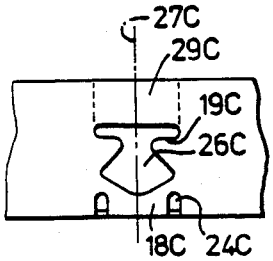

GRID CEILING

The present invention relates to a grid ceiling.

Various forms of grid ceiling have been proposed and one example is shown in No. GB-A-2,122,666, in which the ceiling includes first and second elongate carriers, arranged in first and second sets of parallel carriers, the first and second sets being arranged transverse to one another to form a supporting grid with polygonal, preferably rectangular, spaces therein, with the ends of the second carriers abutting the sides of the first carriers. Grid panels or units are mounted within the spaces, the grid panels or the panels of the grid units having a hollow interior. The grid units are formed of primary and secondary panels, the primary panels extending at an angle, preferably perpendicular, to the secondary panels.

Since the first and second carriers together form rectangular spaces, for which the most common dimensions are in the region of 60×60 cms or 60×120 cms, corresponding to the grid unit dimensions, it will be clear that the edge portions of such ceilings frequently have to be reduced in size to fit a particular ceiling area. However, such adaptation of the frame sections and grid units is either impossible with existing systems or requires aesthetically unacceptable improvisation, use of extra, non-standard profiles and considerable extra time and work, since existing systems are not sufficiently flexible in their application.

It is now proposed, according to the present invention, to provide a grid ceiling comprising a set of first parallel channel section elongate members and a set of second parallel channel section elongate members, the members being arranged transverse to the second members, to form a grid with polygonal spaces therein, each channel shaped member including a lower portion and two spaced side flanges extending upwardly therefrom, at least one integral hook being formed at each of the ends of said second members and co-operating first openings being formed in at least one side flange of said first members at first positions situated at regular, spaced intervals therealong, so that the hooks of said second members can be engaged in said first openings to form said grid ceiling, a series of one or more second openings being formed in at least one side flange of said second member at second positions situated at regular, spaced intervals therealong, the second openings being so shaped that, when said second members are cut at the relevant second positions transverse to the length of the second member, at least one of said integral hooks is formed.

The term "opening" used herein includes apertures which are totally surrounded by portions of the associated flange and also recesses or notches which open into the upper or lower edges of the side flanges.

The regular intervals along the length of the second members at which the second openings are formed can be relatively small. This means that one can easily cut the second members at a position to suit the dimensions of the ceiling to be formeed and when this cut has been effected, the integral hooks are readily formed and one therefore does not have to carry a large stock of different second members to be able to produce a grid ceiling of a desired width and/or length.

The cross-section of the elongate members of the first and second sets may, for example, be V-shaped, U-shaped or part-circular in cross-section, but they preferably include a lower web portion with the two spaced side flanges extending substantially perpendicularly thereto and upwardly therefrom. Whatever the cross-section, the free edges of the side flanges may be provided with inturned rims to add to the rigidity of the elongate members.

The grid ceiling may consist solely of the channel section elongate members which form the polygonal spaces therein, which are preferably rectangular and advantageously square. However, it is also contemplated that the channel section elongate members could form carriers for grid panels mounted in the spaces.

With such a construction, the second members may be provided with supporting apertures or recesses to accommodate support means on grid panels mounted in said spaces, said supporting apertures or recesses being positioned on said at least one side flange of said second members, relative to said second openings which can form said hooks, so that said second openings are covered by the associated grid panels that are mounted in the respective spaces of the grid ceiling.

The support means may be formed integrally with the grid panels or may be in the form of slidable elements movable longitudinally of the individual panels of the grid panels.

The supporting apertures or recesses and the second openings may be interconnected.

If desired, the first members may be provided with supporting apertures or recesses to accommodate support means on grid panels mounted in said openings, said supporting apertures or recesses being positioned on said at least one side flange of said first member relative to said first openings, so that the first openings are covered by the associated grid panels that are mounted in the respective spaces of said grid ceiling.

Again, the supporting apertures or recesses and the first openings may be interconnected. The second openings which can form the hooks can be so shaped that, after cutting, at least one hook is produced on each of the two free ends caused by the cuts at the relevant second positions. Equally, the second openings can be so shaped so as to form a hook on only one end which is produced when the cut is effected.

In order that the present invention may more readily be understood, the following description is given, merely by way of example, reference being made to the accompanying drawings, in which:

FIG. 1 is an exploded perspective view of a portion of one embodiment of grid ceiling according to the invention;

FIG. 2 is an enlarged fragmentary section showing the connection between a grid unit member in the form of a carrier, with a supporting clip in the advanced position;

FIG. 3 is a top plan view of the portion shown in FIG. 2; and

Figure 5:
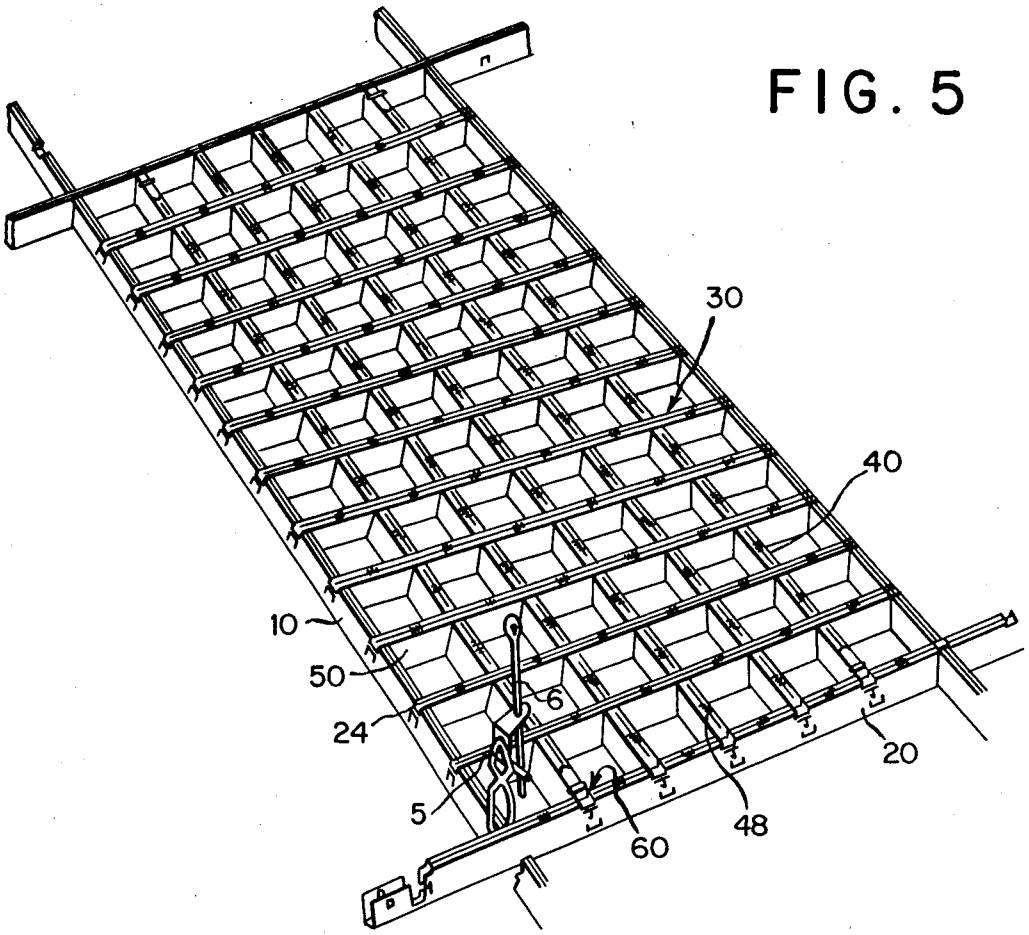

FIGS. 4A, B and C, show three possible forms of second openings in the second members.

Referring first to FIG. 1, a grid ceiling is shown as including a set of parallel first members 10 and a set of parallel second members 20 at right angles thereto, the drawing only showing one of each of these members. Each of these members is of a hollow channel cross-section having a web portion 12 and two spaced side flange portions 14, the upper free ends of which are provided with inturned rims 16. At the ends of the second members are formed downwardly turned hooks 18, having an upper surface 19, the hooks 18 being engageable in inverted U-shaped first openings 22 in the members 10, the first openings being located at first positions situated at regular, spaced intervals along the length of members 10. The upper surfaces 19 have a rounded projection 23 extending forwardly. When the hooks 18 are engaged in the openings 22, the projections slightly deform the members 10 and as the hooks are forced down, the portion of the member above the side flange 14 springs back over the upper surface 19 to hold the hook in place. Each of the members 10, 20 are provided with notches or recesses 24, the notches 24 of the member 10 being immediately above the openings 22. Instead of notches or recesses 24, it is also conceivable to use apertures of an enclosed (surrounded) nature.

Immediately below the recesses 24 of the member 20 are second openings 26''. The recesses 24 and second openings 26 are located at second positions aat regular, spaced intervals along the length of the member 20. The openings 26 are so shaped that when the member 20 is cut along one of the lines 27, at one of the second locations and which passes through the recesses 24 and the second openings 26' and 26'', there will be produced two mirror image hooks 18, when further portions 29 have been cut or bent away. These portions 29 will include the parts of the two side flange portions 14 and parts of the web portions 12. The recesses 24 and openings and 26'' as illustrated will produce two mirror image hooks 18 when a cut is made. They could, however, be so shaped as to produce only one hook.

FIGS. 4A to 4C show three further examples and like parts have been indicated by like reference numerals with the same reference letter as the figure number in question. In FIG. 4A the recess 24A is formed in one piece with the second openings 26A. In FIG. 4B there are upper and lower portions 29B which are neither cut or bent out of the way.

In FIG. 4C the central second opening 26C is shaped to form an upper surface 19C engageable in inverted U-shaped openings 22 in the members 10 and the hooks 18C are each formed by an opening 26C and by a lower recess 24C.

While the grid ceiling may simply consist of the members 10 and 20, these can also form carriers for grid panels 40, 50 in the form of grid panel units 30 or individual panels. These grid units 30 consist of primary grid unit panels 40 and secondary grid unit panels 50 (FIG. 1). These panels are suitably notched, so that they can be interfitted with one another to form several cells of square cross-section. The panels 40, 50 are of similar cross-section to the members 10, 20 and include lower webs 42, side flanges 44 and inturned rims 46, the rims being provided with notches 48. The ends of the panels 40, 50 may be provided with tongues similar to the tongues 18 which can engage in the recesses 24.

As illustrated, however, engageable in the interior of the panels 40, 50, are clips 60 of bent sheet metal, these including an upper saddle portion 62 having downturned end sections 64, the saddle portions 62 overlying the rims 46 and extending downwardly adjacent the side flanges 44. The saddle portion 62 is connected to a body part 66 which is a sliding fit within the interior of the side flanges 44 and has, at its forward end, downwardly angled tongues 68. At the rear end of each clip is a stop member 70 which has a forwardly extending portion 72.

FIG. 2 shows the clip 60 advanced with the tongue 68 engaged in recess 24. In this position the stop 70 engages the left end (in FIG. 2) of the notch 48 with the portion 62 overlying the rims 46. The clip may be retracted with the tongue 68 wholly within the panel 40 and the stop 70 engaged against the right end of the notch 48. In fact while it is preferred to retract the tongue 68, so that it is within the panel, it need only be retracted sufficiently to disengage from recess 24.

In FIG. 1 only the panels 40 have been shown provided with the clips 60, but alternatively or in addition the panels 50 could be provided with such clips to give greater rigidity. If is of course necessary to have at least three clips, which are located on the grid unit at spaced positions to give adequate support of the grid unit.

It will be appreciated that the clips can readily be located and retracted with the finger to remove the grid unit 30.

In order to mount the supporting grid formed by the members 10, 20, there are provided hangers 5 which are themselves supported on a pin 6 by a bracket 7 and include arms 8 resiliently urged towards one another and having inwardly extending lugs 9. In order to mount the first members, 10, one forces them upwardly to cause these arms to spring out and they then spring back in again so that the lugs 9 engage in the upper limb of the inverted U-shaped apertures 22 and in this way the whole assembly can be hung from the ceiling.

It will be appreciated that the structure of the present invention is very easy to mount and is of simple and inexpensive construction, and furthermore enables one to cut off suitable portions of the length of the members to suit dimensions of a particular room or other space.

I claim:

1. A grid ceiling comprising a set of first parallel channel section elongate members and a set of second parallel channel section elongate members, the first members being arranged transverse to the second members, to form a grid with polygonal spaces therein, each channel shaped member including a lower portion and two spaced side flanges extending upwardly therefrom, at least one integral hook being formed at each of the ends of said second members and co-operating first openings being formed in at least one side flange of said first members at first positions situated at regular, spaced intervals therealong, so that the hooks of said second members can be engaged in said first openings to form said grid ceiling, a series of one or more second openings being formed in at least one side flange of said second member at second positions situated at regular, spaced intervals therealong, the second openings being so shaped that, when said second members are cut at the relevant second positions transverse to the length of the second member, at least one of said integral hooks is formed.

2. A grid ceiling according to claim 1, wherein said second members are provided with supporting apertures or recesses to accommodate support means on grid panels mounted in said polygonal spaces, said supporting apertures or recesses being positioned on said at least one side flange of said second members, relative to said second openings which can form said hooks, so that said second openings are covered by the associated grid panels that are mounted in the respective spaces of the grid ceiling.

3. A grid ceiling according to claim 2, wherein said supporting apertures or recesses and said second openings are interconnected.

4. A grid ceiling according to claim 1, wherein said first members are provided with supporting apertures or recesses to accommodate support means on grid panels mounted in said spaces, said supporting apertures or recesses being positioned on said at least one side flange of said first member relative to said first openings, so that the first openings are covered by the associated grid panels that are mounted in the respective spaces of said grid ceiling.

5. A grid ceiling according to claim 4, wherein said supporting apertures or recesses of said first members and said first openings are interconnected.

6. A grid ceiling according to any preceding claim, wherein the second opening which can form the hooks are so shaped that, after cutting, at least one hook is produced on each of the two free ends caused by the cuts at the relevant second positions.

7. A grid ceiling according to claim 6, wherein the channel section elongate members are of V or U-shaped cross-section.

8. A grid ceiling according to claim 6, wherein said channel section elongate members include a lower web portion and two spaced side flanges extending substantially perpendicularly thereto and upwardly therefrom.

9. A grid ceiling according to claim 6, wherein said side flanges include inturned rims.

* * * * *

UNITED STATES PATENT AND TRADEMARK OFFICE

CERTIFICATE OF CORRECTION

PATENT NO. : 4,665,674

DATED : May 19, 1987

INVENTOR(S) : Johannes A. Brugman

It is certified that error appears in the above-identified patent and that said Letters Patent is hereby corrected as shown below:

In the patent specification:

Column 2, line 56, delete "and".

Column 2, line 58, delete ".", and insert --; and--.

Column 2, after line 58 and before line 59, insert the following paragraph:

--Fig. 5 is a perspective view of grid panels mounted within the rectangular openings.--

Signed and Sealed this

Sixteenth Day of February, 1988

*Attest:*

DONALD J. QUIGG

*Attesting Officer*

*Commissioner of Patents and Trademarks*